United States Patent [19]

Lettenmeyer

[11] Patent Number: 4,597,035

[45] Date of Patent: Jun. 24, 1986

[54] LAMP STRUCTURE

[76] Inventor: Horst Lettenmeyer, Römerstrasse 28, 8000 München 40, Fed. Rep. of Germany

[21] Appl. No.: 599,209

[22] Filed: Apr. 12, 1984

Related U.S. Application Data

[63] Continuation of Ser. No. 276,621, Jun. 23, 1981, abandoned.

[51] Int. Cl.[4] ..... F21M 3/08; F21S 3/00

[52] U.S. Cl. ..... 362/219; 362/282; 362/322

[58] Field of Search ..... 362/219, 223, 224, 225, 362/238, 239, 240, 277, 282, 311, 322, 323, 351, 354, 369, 227

[56] References Cited

U.S. PATENT DOCUMENTS

| | | | |
|---|---|---|---|
| Re. 12,795 | 5/1908 | Beuttell | 362/219 |
| 2,137,732 | 11/1938 | Swanson | 362/227 |
| 2,200,067 | 5/1940 | Lehman | 362/282 |
| 2,597,739 | 5/1952 | Lacy et al. | 362/219 |
| 2,807,710 | 9/1957 | Williams | 362/223 |
| 3,140,055 | 7/1964 | Long | 362/223 |
| 3,633,023 | 1/1972 | Castiglioni | 362/219 |
| 4,285,032 | 8/1981 | Honda | 362/224 |

FOREIGN PATENT DOCUMENTS

| | | | |
|---|---|---|---|
| 0105807 | 2/1923 | France . | |
| 0609725 | 8/1926 | France . | |
| 1143577 | 10/1957 | France | 362/219 |
| 1343509 | 3/1962 | France . | |
| 0963309 | 7/1964 | United Kingdom | 362/219 |

*Primary Examiner*—W. R. Wolfe

*Attorney, Agent, or Firm*—Townsend and Townsend

[57] ABSTRACT

A lamp structure and, more specially, a strip lighting fixture has an outer casing tube with a slot running between its ends and at least two double-ended lamps or bulbs placed within it and joined up electrically in series with a current supply, the bulbs being kept electrically in contact by one or more springs acting axially thereon.

3 Claims, 1 Drawing Figure

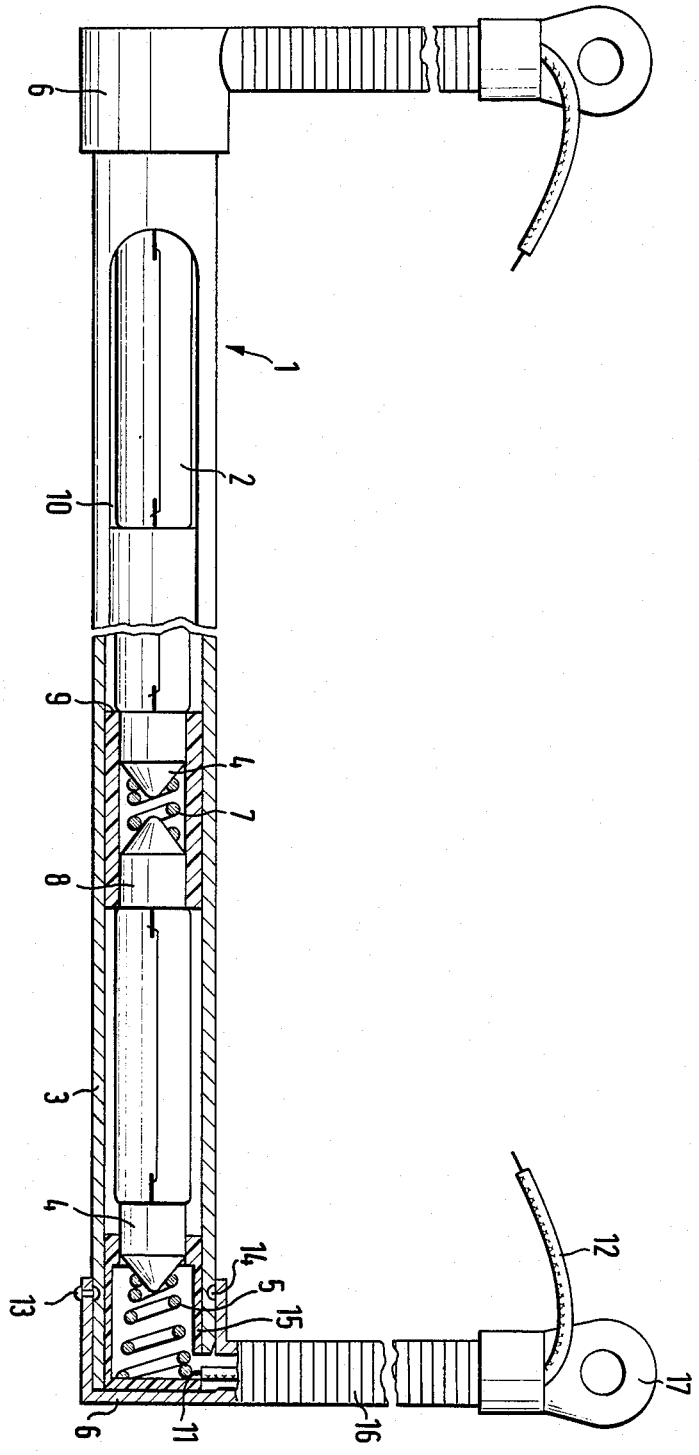
17
12
16
15
5
14
11
6
13
4
3
8
7
4
9
2
10
1
9

LAMP STRUCTURE

This is a continuation Ser. No. 276,621 filed June 23, 1981, now abandoned.

BACKGROUND OF THE INVENTION

The present invention is with respect to a lamp system and, more specially, to a strip lamp system.

At the present time fluorescent lamps are widely used for a large number of different purposes. Such lamps in the form of tubes, however, have to have supporting systems such as starters, compensation capacitors and ballast chokes so that such a lamp unit is generally complex and high in price and once any part of it gets out of order, a new, complete fluorescent unit is needed to take its place. Moreover, fluorescent lamps have to be run on line voltage or even higher voltages, this being undesired or not possible in many cases for which such lamps might otherwise be used. The light quality of fluorescent lamps is, in many cases, very "cold" and unnatural so that it may not be used for lighting things of great value such as pictures and other works of art, exhibits in museums and in connection with showcases and the like.

SHORT OUTLINE OF THE INVENTION

For this reason, one purpose of the invention is that of designing a tube-like lamp system or strip lighting fixture which may be produced very simply and at a low price and gives a natural, warm light and, furthermore, may be run on a lower voltage than the line voltage. Furthermore, in the lamp structure of the invention the upkeep is to be very simple inasmuch as it is easy to put in new lamps.

For effecting this purpose and further purposes, in the invention at least two double-ended lamps are placed end to end as a light source in a lamp casing tube.

Double-ended incandescent lamps or bulbs are produced so as to have a long working life and in large amounts for motorvehicles and for signals and, for this reason give good value. Furthermore, they give a natural, warm light, producing tasteful effects, unlike fluorescent lamps.

As part of a preferred working example of the invention at the outer contact ends of the line of double-ended lamps, compression springs and, more specifically, spiral springs are placed for forcing together the double-ended lamps at their contact ends so that a high-level electrical contact is produced and the resistance between one lamp and the next is kept as low as possible. Using compression springs, it is very simple to put in a new double-ended lamp when one lamp has burned out, because it is only necessary for the lamp to be pushed against the spring force of the compression spring and slipped out of the lamp casing tube. The putting in place of the new double-ended lamp is quite as simple.

As part of a further possible form of the invention between one contact end of a double-ended lamp and the next contact end, there is an inbetween compression spring which, as well, is electrically conducting and is responsible for a trouble-free, elastic contacting effect between the two separate double-ended lamps. The inbetween compression springs are, however, in most cases not necessary, more specially if the lamp casing tube is not overly long. In such cases, one or two compression springs not between the lamps will be all that is needed.

In some cases, in the case of generally long lamp casing tubes or, if such tubes are somewhat curved so that the double-ended lamps are forced together with an angle of less than 180° between them, the inbetween compression springs are responsible for better contact between the separate double-ended lamps.

To make certain that the contact ends of the double-ended lamps do not come into contact with the normally grounded lamp casing tube, as part of a further preferred working example of the invention, sleeves of insulating material, which is best of such a nature as to be temperature-resistant up to 120° C., as for example Teflon, is used. The sleeve is best placed round the two cylindrical outer faces of one contact end and the next one of two end-to-end double contact lamps or bulbs and, if present, the inbetween compression spring. This sleeve is furthermore used as a spacer to make certain that the glass of the double-ended lamps does not come up against the, lamp casing tube or, for example, on shaking the structure, that any such contact does not cause stresses in the glass so that the double-ended lamp might be broken.

The lamp casing tube has, dependent on the purpose for which the design is made, a broader or narrower slot for a certain part of its length for the light to come from the lamps. More specifically, the lamp tubular casing is turningly joined with the support of the lamp and is, more specially, electrically joined up therewith for grounding it. By turning the lamp casing tube, it is, for this reason, possible for the light therefrom to be pointed at a given thing to be lighted as for example a picture, in the best way possible and so that the purpose desired in each separate case is effected.

The lamp structure or strip lighting fixture may, more specially, be used for lighting oil-paintings, pictures showcases, notice boards and advertisements such as posters etc. Unlike spotlights as more specially used presently for such purposes, the lamp structure of the invention is responsible for a more even lighting up and is responsible for a very much lower heating effect, such heat undergoing a better distribution and not being limited to a small part of the area of the thing being lighted up (as for example an oil-painting), unlike the case of a spotlight. For this reason, pictures and oil-paintings which have been varnished, and other things likely to be damaged by heat, will be in no danger when lighted with the lamp structure of the present invention.

As part of a further development of the present invention, the lamp structures have a number of lamp casing tube supports in which a number of such casing tubes are placed parallel to each other so that, in a very simple way and at a very low price the most different lighting systems, as for example flat lighting systems, lighting systems with upright, parallel lighting tubes etc. may be used.

Detailed account of working example of the invention

An account will now be given of a working example of the invention.

In the one light or lamp structure, that is to say the light tube casing support 6 there is a compression spring 5 made of conducting material with its one end resting against a conducting plate which is insulated from the rest of the lamp structure. This plate is joined up with a connection wire 12. Near the ends of the end casing tube support 6 there are rivets 13, the inner rivet head, in each case, being taken up in a pocket 14 made therefor in a lamp casing tube 3. The casing tube is, for this reason, fixed in position and may not be moved axially in relation to the rest of the lamp structure, while on the other hand, the lamp casing tube 3, because of the presence of the pocket or groove 14 on its outer face, may be turned about its lengthways axis. For purposes of insulation, the compression spring 5 is placed within electrically insulating sleeve 15 which has an outer contact end 4 of the double-ended lamp 2 furthest to the right in the figure, stretching into and through it. This double-ended lamp 3, that is to say its outer contact end 4 is in contact with compression spring 5 which, on the one hand, is responsible for producing an electrical connection between the wire 12 and the lamp's contact end and, on the other hand, for keeping the double-ended lamp well up against one or more further double-ended lamps in the lamp casing tube so that between the contact ends 4 of the double-ended lamps or bulbs, a good electrical contact is made certain of.

For stopping the contact ends 4 of the double-ended lamps 2 from coming up against the lamp casing tube 3, which is normally grounded, sleeves 9 are present fully covering up the outer faces of the contact ends 4. These sleeves are best made of a synthetic resin, which is resistant to temperatures of up to about 120° C. and which is electrically insulating. Polyacetal synthetic resin (POM) is resistant to temperatures between −50° and +150° C., has very good insulating properties, and may, for this reason, well be used as the sleeve material.

In the working example to be seen, an inbetween compression spring 7 is placed between one contact end and the next one of two double-ended lamps. However, this inbetween compression spring 7 is not needed in all cases and if not used, the points of the contact ends 4 of the double-ended lamps 2 will come up against each other without anything inbetween, a good contact being made because of the spring effect of compression spring 5. It is naturally then necessary for the sleeve 9 to be made somewhat shorter or, still better, to be made with a somewhat greater inner diameter so that there is no danger of the end of the sleeve running up against the end of the glass; in fact, the double-ended lamp or bulb is able to be pushed with its glass part so far into the sleeve, at least, that the points of the contact ends 4 come up against each other.

On the right hand side the lamp structure, the lamp casing tube, the sleeves and the compression springs but, however, not the double-ended lamp itself are to be seen in cross-section. On the left hand side of the figure, the lamp structure or strip lighting fixture is to be seen from the outside. On the lamp casing tube supports 6, support arms 16 and support eyepieces 17 will be seen for fixing the lamp structure on the wall or on the ceiling.

It will generally be clear that the lamp structure of the invention is very simple in design. It may be made shorter or longer without very much trouble and in a simple way, using the same lamp structure or lamp casing tube supports with different lamp casing tubes, something which is not possible with normally used fluorescent strip lighting units. In making a selection of the design of the casing tube in the present invention, the only point to be noted is that of seeing that the tubes in their length, have to be a whole multiple of the length of the double-ended lamps or bulbs.

In comparison with fluorescent lamps, dependent on the use of starters, the lamp system of the present invention is responsible for the very useful effect that it may be run with different voltages, that is to say may be used with a dimmer and is not responsible for any arc'ing on being switched.

I claim:

1. A light fixture having at least two tubular lamps as light sources serially arranged one behind the other in a light pipe, wherein between each two opposing contact ends of the tubular lamps electrically conducting compression springs are arranged, characterized in that a compression spring (5) is in contact with the outer, electrically conductive contact ends (4) of the outermost light tubes (2), the other ends of the compression springs being supported by the body (6) of the light fixture, in that electrically non-conductive sleeves (9) are disposed about cylindrical peripheral surfaces (8) of the contact ends (4) of the tubular lamps (2), the sleeves (9) being movable axially relative to the tube (3) and the surfaces (8) of the tubular lamps (2), which sleeves serve to maintain the spacing and symmetry, in that the light pipe (3) has at least one longitudinally extending light discharge slot (10), and in that the ends of the light pipe (3) are mounted in the light fixture body (6) so that it is rotatable about its longitudinal axis for changing the orientation of the light discharge slot (10).

2. A lamp structure comprising:

a pair of casing supports;

an opaque casing tube rotatably disposed between said supports, and having a lengthwise light outlet slot;

at least two double-ended tubular incandescent lamps disposed with said tube;

at least one compression spring, one end being in contact with a lamp end adjacent a casing support and a second end being in contact with the casing support; and an electrically insulating centering sleeve, within and in contact with said tube, disposed around adjacent ends of said at least two lamps, the centering sleeve sized to substantially cover said adjacent ends and to center the lamp ends with said tube, the centering sleeve movable axially relative to the tube and to the lamp ends.

3. The lamp structure of claim 2 further comprising a further compression spring placed between and in electrical contact with adjacent ends of two said lamps.

* * * * *